US008763541B2

(12) United States Patent
Tokura

(10) Patent No.: US 8,763,541 B2
(45) Date of Patent: Jul. 1, 2014

(54) SEWING MACHINE AND NON-TRANSITORY COMPUTER-READABLE MEDIUM STORING SEWING MACHINE CONTROL PROGRAM

(75) Inventor: Masashi Tokura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 418 days.

(21) Appl. No.: 13/213,570

(22) Filed: Aug. 19, 2011

(65) Prior Publication Data

US 2012/0048162 A1 Mar. 1, 2012

(30) Foreign Application Priority Data

Aug. 24, 2010 (JP) ..... 2010-186853

(51) Int. Cl.
*D05B 21/00* (2006.01)

(52) U.S. Cl.
USPC ..... 112/102.5; 112/470.03; 700/138

(58) Field of Classification Search
USPC ..... 112/102.5, 103, 470.01, 470.03, 112/470.04, 470.06, 475.18, 475.19; 700/136–138
See application file for complete search history.

(56) References Cited

U.S. PATENT DOCUMENTS

| | | | | |
|---|---|---|---|---|
| 4,834,008 | A | 5/1989 | Sadeh et al. | |
| 4,876,976 | A * | 10/1989 | Brower et al. | 112/475.05 |
| 4,969,410 | A * | 11/1990 | Brower et al. | 112/475.19 |
| 5,095,835 | A | 3/1992 | Jernigan et al. | |
| 5,271,345 | A | 12/1993 | Matschulat et al. | |
| 5,323,722 | A | 6/1994 | Goto et al. | |
| 5,553,559 | A * | 9/1996 | Inoue et al. | 112/102.5 |
| 5,855,176 | A * | 1/1999 | Takenoya et al. | 112/102.5 |
| 5,911,182 | A | 6/1999 | Uyama et al. | |
| 6,032,594 | A | 3/2000 | Komuro | |
| 6,167,822 | B1 | 1/2001 | Miyasako et al. | |
| 6,173,665 | B1 | 1/2001 | Sekine | |
| 6,263,815 | B1 | 7/2001 | Furudate | |
| 6,499,513 | B1 * | 12/2002 | Couch | 112/470.03 |
| 6,820,565 | B1 | 11/2004 | Kawaguchi et al. | |

(Continued)

FOREIGN PATENT DOCUMENTS

| | | |
|---|---|---|
| EP | 0 309 069 A2 | 3/1989 |
| JP | A-1-94891 | 4/1989 |

(Continued)

OTHER PUBLICATIONS

May 3, 2012 Office Action issued in European Application No. 11 153 953.2.

(Continued)

*Primary Examiner* — Nathan Durham
(74) *Attorney, Agent, or Firm* — Oliff PLC

(57) ABSTRACT

A sewing machine includes an image capture portion that captures an image of a sewing object that is held by an embroidery frame, a data acquisition portion that acquires embroidery data for sewing an embroidery pattern, an area setting portion that sets a sewing area that is an area within which the embroidery pattern can be sewn on the sewing object, a setting acquisition portion that acquires, as a reference setting, a setting of at least one of a position and an angle of the embroidery pattern in relation to a marker that is disposed on the sewing object, and an area specification portion that specifies an image capture object area for the image capture portion, based on conditions that include the sewing area, the embroidery data, and the reference setting.

8 Claims, 7 Drawing Sheets

(56) References Cited

U.S. PATENT DOCUMENTS

| | | | | |
|---|---|---|---|---|
| 7,155,302 | B2 | 12/2006 | Muto et al. | |
| 7,325,502 | B2 | 2/2008 | König et al. | |
| 7,392,755 | B2 | 7/2008 | Kato et al. | |
| 7,702,415 | B2 * | 4/2010 | Roos | 700/138 |
| 7,854,207 | B2 * | 12/2010 | Kuki et al. | 112/102.5 |
| 8,091,493 | B2 | 1/2012 | Tokura | |
| 2007/0206371 | A1 | 9/2007 | Yamasaki | |
| 2009/0188413 | A1 | 7/2009 | Hirata et al. | |
| 2009/0217850 | A1 | 9/2009 | Tokura | |
| 2009/0266282 | A1 | 10/2009 | Suzuki et al. | |
| 2010/0236463 | A1 | 9/2010 | Fujihara et al. | |
| 2011/0202165 | A1 | 8/2011 | Tokura | |

FOREIGN PATENT DOCUMENTS

| | | |
|---|---|---|
| JP | A-2004-254987 | 9/2004 |
| JP | A-2009-172123 | 8/2006 |
| JP | A-2009-201704 | 9/2009 |
| JP | A-2010-220694 | 10/2010 |
| WO | WO 2009/085005 A1 | 7/2009 |

OTHER PUBLICATIONS

Extended European Search Report issued in European Application No. 11177000.4 on Jan. 4, 2012.

Extended European Search Report issued in European Patent Application No. 11153953.2 on Jun. 17, 2011.

Mar. 5, 2012 Notice of Allowance issued in U.S. Appl. No. 13/013,329.

Aug. 20, 2012 Notice of Allowance issued in U.S. Appl. No. 13/013,329.

* cited by examiner

SEWING MACHINE AND NON-TRANSITORY COMPUTER-READABLE MEDIUM STORING SEWING MACHINE CONTROL PROGRAM

CROSS-REFERENCE TO RELATED APPLICATION

This application claims priority to Japanese Patent Application No. 2010-186853, filed Aug. 24, 2010, the content of which is hereby incorporated herein by reference.

BACKGROUND

The present disclosure relates to a sewing machine that includes an image capture portion and to a non-transitory computer-readable medium that stores a sewing machine control program.

A sewing machine is known that includes an image capture portion such as a camera or the like. Image data that the image capture portion has generated are used in processing that, for example, detects a position of a marker that is disposed on a sewing object. Based on the detected position of the marker, this sort of sewing machine sets a sewing position for an embroidery pattern.

SUMMARY

In the known sewing machine, an area within an embroidery frame (specifically, a sewing area) is defined as an image capture object area. In a case where the size of the image capture object area is greater than the size of an image capture area of the image capture portion, the sewing machine may capture images over the entire image capture object area by performing a plurality of rounds of image capture, varying the relative positions of the image capture portion and the embroidery frame for each round. Therefore, the greater the size of the embroidery frame, the more rounds of image capture may be performed. The time that is required for the processing that detects the position of the marker may increase accordingly.

Various exemplary embodiments of the broad principles derived herein provide a sewing machine, and a non-transitory computer-readable medium that stores a sewing machine control program, that make it possible to appropriately set the image capture object area for detecting the marker.

Exemplary embodiments provide a sewing machine that includes an image capture portion that captures an image of a sewing object that is held by an embroidery frame, a data acquisition portion that acquires embroidery data for sewing an embroidery pattern, an area setting portion that sets a sewing area that is an area within which the embroidery pattern can be sewn on the sewing object, a setting acquisition portion that acquires, as a reference setting, a setting of at least one of a position and an angle of the embroidery pattern in relation to a marker that is disposed on the sewing object, and an area specification portion that specifies an image capture object area for the image capture portion, based on conditions that include the sewing area, the embroidery data, and the reference setting.

Exemplary embodiments also provide a non-transitory computer-readable medium storing a control program executable on a sewing machine. The program includes instructions that cause a computer of the sewing machine to perform the steps of causing an image capture portion of the sewing machine to generate image data that indicates a captured image of a sewing object that is held by an embroidery frame, acquiring embroidery data for sewing an embroidery pattern, setting a sewing area that is an area within which the embroidery pattern can be sewn on the sewing object, acquiring, as a reference setting, a setting of at least one of a position and an angle of the embroidery pattern in relation to a marker that is disposed on the sewing object, and specifying an image capture object area for the image capture portion, based on conditions that include the sewing area, the embroidery data, and the reference setting.

BRIEF DESCRIPTION OF THE DRAWINGS

Exemplary embodiments will be described below in detail with reference to the accompanying drawings in which.

DETAILED DESCRIPTION

Hereinafter, a multi-needle sewing machine (hereinafter referred to as a "sewing machine") 1 according to an embodiment will be explained with reference to the drawings.

The physical configuration of the sewing machine 1 will be explained with reference to FIGS. 1 to 4. In the explanation that follows, the lower left side, the upper right side, the upper left side, and the lower right side of the page of FIG. 1 respectively correspond to the front, the rear, the left, and the right of the sewing machine 1.

Figure 1:
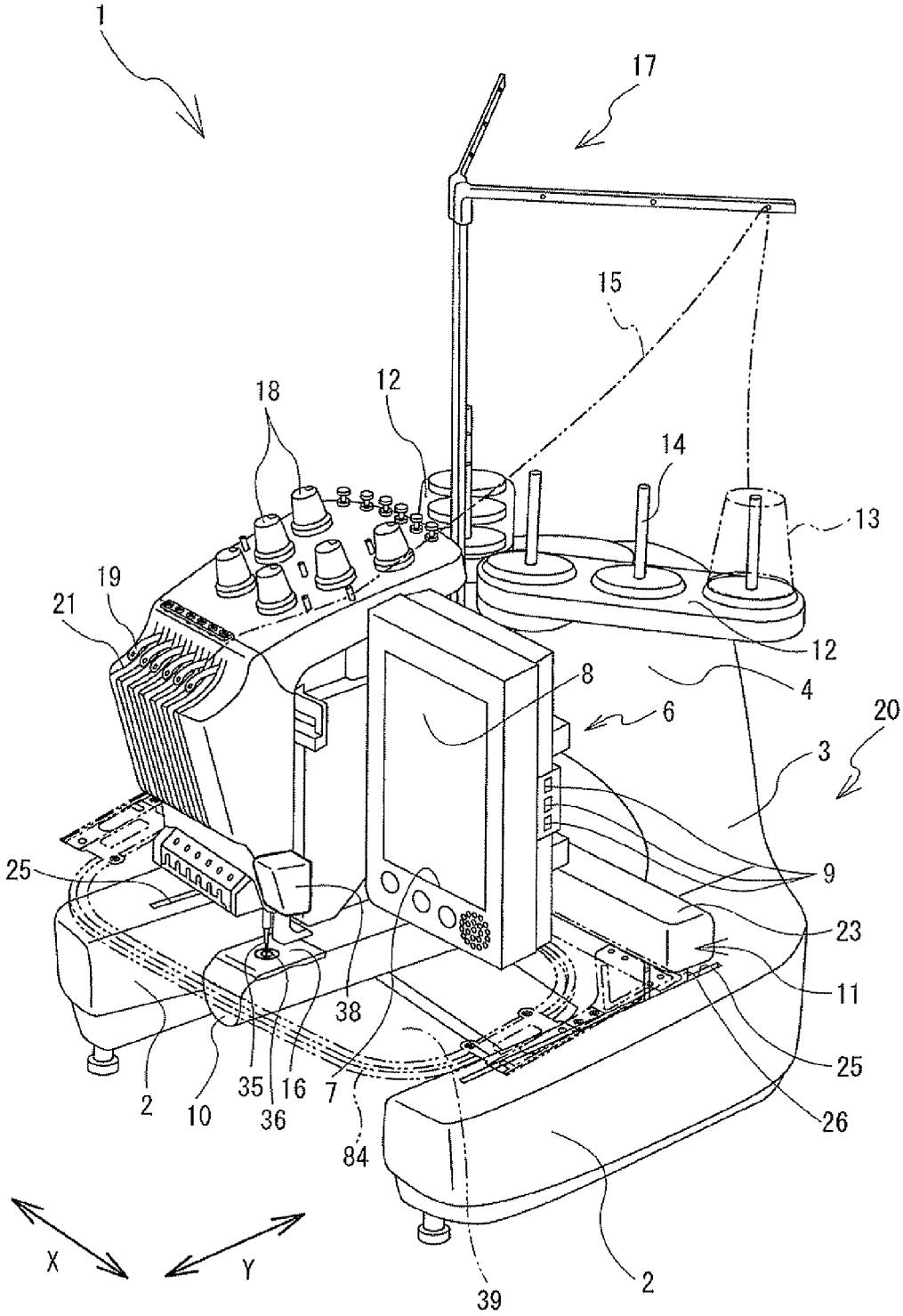
FIG. 1 is an oblique view of a multi-needle sewing machine 1.

As shown in FIG. 1, a body 20 of the sewing machine 1 includes a supporting portion 2, a pillar 3, and an arm 4. The supporting portion 2 is formed in an inverted U shape in a plan view, and supports the entire sewing machine 1. A pair of left and right guide slots 25 that extend in a front-rear direction is provided on the top face of the supporting portion 2. The pillar 3 extends upward from the rear end of the supporting portion 2. The arm 4 extends forward from the upper end of the pillar 3. A needle bar case 21 is mounted on the front end of the arm 4 such that the needle bar case 21 can be moved to the left and to the right. The needle bar case 21 and a needle bar case moving mechanism 40, which moves the needle bar case 21, will be described in detail below.

An operation portion 6 is provided on the right side of the arm 4 at a central position in the front-rear direction. A vertically extending shaft (not shown in the drawings) serves as an axis of rotation on which the operation portion 6 is pivotally supported by the arm 4. The operation portion 6 includes a liquid crystal display (LCD) 7, a touch panel 8, and connectors 9. An operation screen for a user to input commands, for example, may be displayed on the LCD 7. The touch panel 8 may be used to accept commands from the user. The user may use a finger, a dedicated stylus pen, or the like to touch a position of the touch panel 8 that corresponds to a position of an image that is displayed on the LCD 7 and that shows an input key or the like so that the user can select a sewing pattern, sewing condition, and the like. Hereinafter, an operation touching the touch panel 8 is referred to as a "panel operation". The connectors 9 are USB standard connectors, to which a USB device 160 (refer to FIG. 5) can be connected.

A cylinder bed 10 that extends forward from the bottom end of the pillar 3 is provided underneath the arm 4. A shuttle (not shown in the drawings) is provided in the interior of the front end of the cylinder bed 10. A bobbin (not shown in the drawings) on which a lower thread (not shown in the drawings) is wound may be accommodated in the shuttle. A shuttle drive mechanism (not shown in the drawings) is also provided in the interior of the cylinder bed 10. The shuttle drive mechanism rotationally drives the shuttle. A needle plate 16 that is rectangular in a plan view is provided on the top face of the cylinder bed 10. A needle hole 36 through which a needle 35 can pass is provided in the needle plate 16.

A Y carriage 23 of an embroidery frame moving mechanism 11 is provided underneath the arm 4. The sewing machine 1 performs sewing of an embroidery pattern on a sewing object 39 that is held by an embroidery frame 84 as the embroidery frame 84 is moved to the left and the right, and forward and backward, by an X axis motor 132 (refer to FIG. 5) and a Y axis motor 134 (refer to FIG. 5) of the embroidery frame moving mechanism 11. The sewing object 39 may be a work cloth, for example. The embroidery frame moving mechanism 11 will be described in detail below.

A right-left pair of spool platforms 12 is provided at the rear face side of the top face of the arm 4. Three thread spool pins 14 are provided on each of the spool platforms 12. The thread spool pins 14 are pins that extend in the vertical direction. The thread spool pins 14 may pivotally support thread spools 13. The number of the thread spools 13 that can be placed on the one pair of the spool platforms 12 is six, the same as the number of needle bars 31. Upper threads 15 may be supplied from the thread spools 13 that are attached to the spool platforms 12. Each of the upper threads 15 may be supplied, through a thread guide 17, a tensioner 18, and a thread take-up lever 19, to an eye (not shown in the drawings) of each of the needles 35 that are attached to the bottom ends of the needle bars 31 (refer to FIG. 2).

Figure 2:
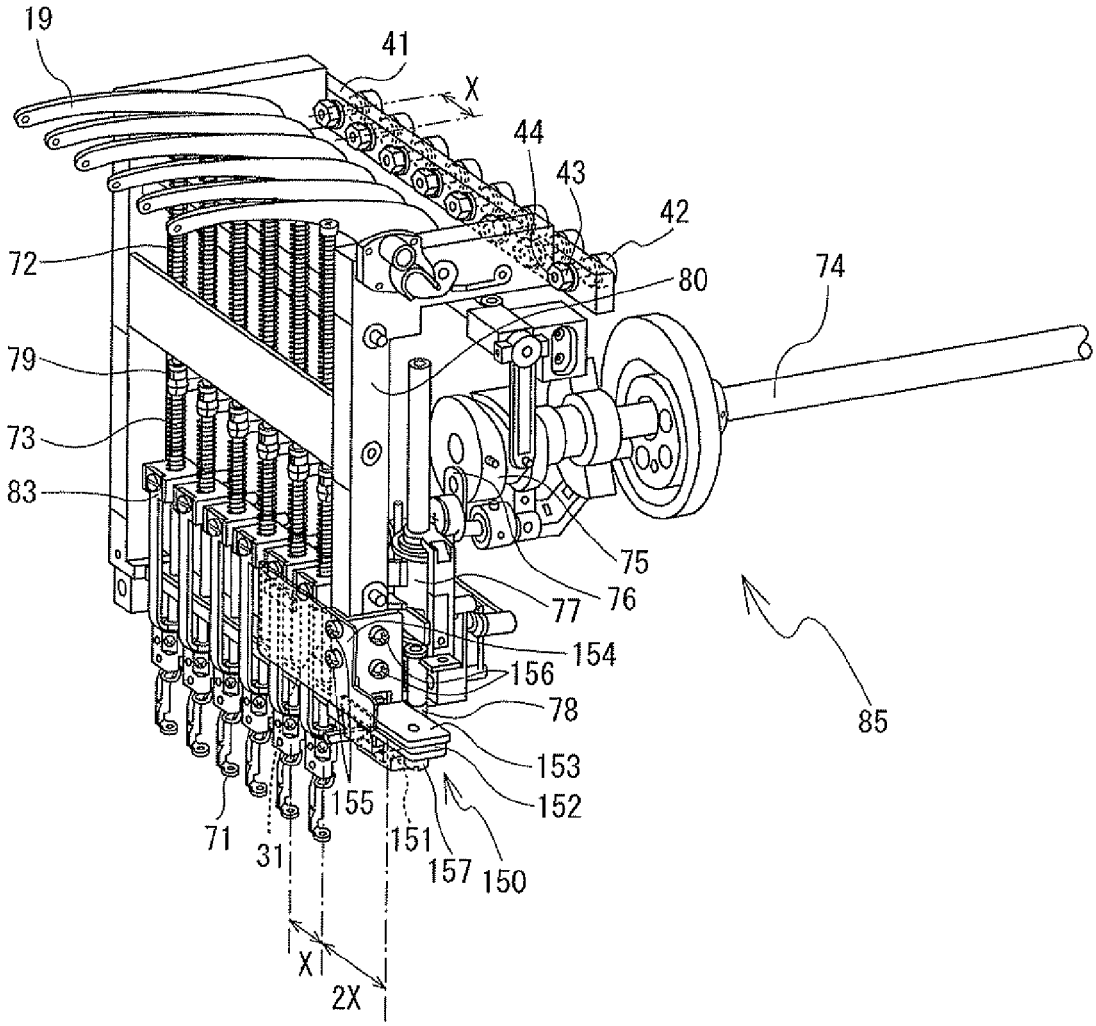
FIG. 2 is an oblique view of a needle bar drive mechanism 85 that is located inside a needle bar case 21.

An internal mechanism of the needle bar case 21 will be explained with reference to FIG. 2. As shown in FIG. 2, the six needle bars 31, which extend in the vertical direction, are provided inside the needle bar case 21 at equal intervals X in the left-right direction. Needle bar numbers are respectively assigned to the needle bars 31 in order to identify the individual needle bars 31. In the present embodiment, the needle bar numbers 1 to 6 are assigned to the needle bars 31 in order starting from the right side in FIG. 3. The needle bars 31 are supported by two upper and lower securing members (not shown in the drawings) that are secured to a frame 80 of the needle bar case 21 such that the needle bars 31 can slide up and down. A needle bar follow spring 72 is provided on the upper half of each of the needle bars 31. A presser spring 73 is provided on the lower half of each of the needle bars 31. A needle bar guide 79 is provided between the needle bar follow spring 72 and the presser, spring 73. A presser guide 83 is provided below the presser spring 73. The needle bars 31 may be slid up and down by a needle bar drive mechanism 85. The needle bar drive mechanism 85 includes a sewing machine motor 122 (refer to FIG. 5), a thread take-up lever drive cam 75, a coupling member 76, a transmitting member 77, a guide bar 78, and a coupling pin (not shown in the drawings). The sewing machine motor 122 is a drive source for the needle bar drive mechanism 85. The needles 35 (refer to FIG. 1) may be attached to the bottom ends of the needle bars 31. A presser foot 71 extends from each of the presser guides 83 to slightly below the bottom end portion (the tip portion) of the corresponding needle 35. A presser foot 71 may operate in conjunction with the up-and-down movement of the corresponding needle bar 31, and may intermittently press the sewing object 39 (refer to FIG. 1) downward.

An image sensor holding mechanism 150 is attached to the lower portion of the right side face of the frame 80. The image sensor holding mechanism 150 includes an image sensor 151, a holder 152, a supporting member 153, and a connecting plate 154. The image sensor 151 is a known complementary metal oxide semiconductor (CMOS) image sensor. The holder 152 supports the image sensor 151 in a state in which a lens (not shown in the drawings) of the image sensor 151 faces downward. The center of the lens of the image sensor 151 is in a position that is at a distance 2× from the needle bar 31 that is the farthest to the right. The supporting member 153 has an L shape when viewed from the front. The supporting member 153 supports the connecting plate 154 and the holder 152. The supporting member 153 is secured to the lower portion of the right side face of the frame 80 by screws 156. The holder 152 is secured to the bottom face of the supporting member 153 by a screw 157. The connecting plate 154 is a plate that is L-shaped when viewed from the front. The connecting plate 154 electrically connects the image sensor 151 to a control portion 140 that will be described below (refer to FIG. 5). The connecting plate 154 is secured to the front face of the supporting member 153 by screws 155. The front face, the top face, and the right side face of the image sensor holding mechanism 150 are covered by a cover 38 (refer to FIG. 1).

Figure 3:
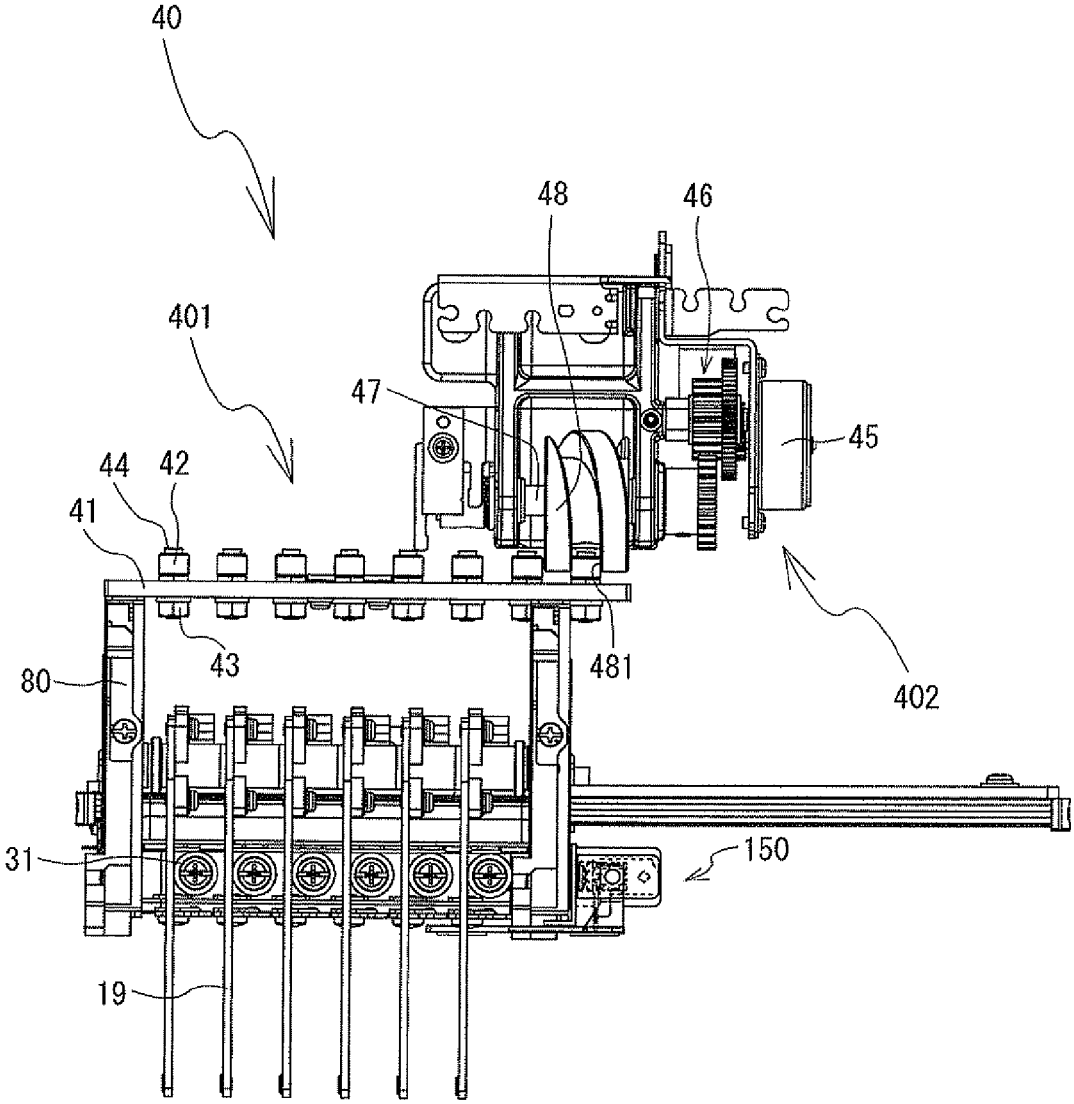
FIG. 3 is a plan view of a needle bar case moving mechanism 40.

A needle bar case moving mechanism 40, which moves the needle bar case 21, will be explained with reference to FIGS. 2 and 3. In FIG. 3, the lower side, the upper side, the left side, and the right side of the page respectively correspond to the front, the rear, the left, and the right of the sewing machine 1.

As shown in FIG. 3, the needle bar case moving mechanism 40 includes an engaging roller portion 401 and a needle bar case drive portion 402. The engaging roller portion 401 includes a plate 41, engaging rollers 42, nuts 43, and shoulder bolts 44. As shown in FIGS. 2 and 3, the plate 41 is attached to the upper rear edge of a frame 80. The plate 41 is long in the left-right direction. Each of the eight engaging rollers 42 is attached to rear face of the plate 41 by one of the shoulder bolts 44. Although not shown in detail in the drawings, each of the engaging rollers 42 has a round cylindrical shape. The engaging rollers 42 are supported by the shoulder bolts 44 such that the engaging rollers 42 can rotate, but cannot move in the axial direction of the engaging rollers 42. Each of the shoulder bolts 44 is inserted into a hole in the plate 41 (not shown in the drawings) and is secured by one of the nuts 43. The intervals between the central axis lines of the engaging rollers 42 are all the same as the intervals X between the needle bars 31. The height positions at which the eight engaging rollers 42 are attached are all the same.

The needle bar case drive portion 402 is located in the rear of the plate 41 in the interior of the arm 4 (refer to FIG. 1). The needle bar case drive portion 402 includes a needle bar case motor 45, a gear portion 46, a rotating shaft 47, and a helical cam 48. The needle bar case motor 45 is a pulse motor. The needle bar case motor 45 is secured such that the axial direction of an output shaft (not shown in the drawings) is the left-right direction. The needle bar case motor 45 may rotate the helical cam 48 by a specified amount by transmitting power to the rotating shaft 47 through the gear portion 46. The rotating shaft 47 is supported in parallel to the output shaft of the needle bar case motor 45. The helical cam 48 is secured to the outer circumference of the rotating shaft 47. The helical cam 48 is constantly engaged with one of the eight engaging rollers 42. The helical cam 48 includes a positioning portion 481. In a case where the rotation of the rotating shaft 47 is stopped, one of the eight engaging rollers 42 is engaged with the positioning portion 481 of the helical cam 48. The positioning portion 481 is shaped such that the position in the left-right direction of the engaging roller 42 that is engaged with the helical cam 48 does not change in a case where the rotating shaft 47 has rotated by a specified angle. The positional relationship between the helical cam 48 and the engaging roller 42 that engages with the helical cam 48 is the same, no matter which of the engaging rollers 42 is engaged with the helical cam 48.

The operation of moving the needle bar case 21 will be explained with reference to FIGS. 2 and 3. The needle bar case 21 may be moved by the needle bar case moving mechanism 40 in the left-right direction (the horizontal direction) in relation to the body 20 of the sewing machine 1 (refer to FIG. 1). With each full revolution of the helical cam 48, the needle bar case moving mechanism 40 may move the needle bar case 21 a distance X in the left-right direction. The direction in which the needle bar case 21 is moved is determined in accordance with the direction of rotation of the helical cam 48. In a case where the helical cam 48 rotates counterclockwise as seen from the right side, the needle bar case 21 is moved to the left. In a case where the helical cam 48 rotates clockwise as seen from the right side, the needle bar case 21 is moved to the right.

Numbers from 1 to 8 are assigned to the engaging rollers 42, in accordance with the positions of the engaging rollers 42, starting from the left. A state in which the positioning portion 481 is engaged with the number 6 engaging roller 42, for example, may be deemed to be an initial position. In this state, the needle bar 31 with the needle bar number 1 is positioned directly above the needle hole 36. In a case where the helical cam 48 is rotated clockwise as seen from the right, the number 6 engaging roller 42 is slid toward the right by the helical cam 48, and the frame 80 starts moving toward the right in relation to the body 20 (refer to FIG. 1). Next, the engagement of the number 6 engaging roller 42 with the helical cam 48 is released, and the number 5 engaging roller 42 engages with the helical cam 48. Thus, in a case where the helical cam 48 is rotated clockwise one full revolution from the initial position as seen from the right, the frame 80 may be moved toward the right by the distance X, and the needle bar 31 with the needle bar number 2 may be positioned directly above the needle hole 36. In contrast, in a case where the helical cam 48 is rotated counterclockwise one full revolution as seen from the right, the frame 80 may be moved toward the left by the distance X in relation to the body 20. Thus, for every full revolution of the helical cam 48, the needle bar case moving mechanism 40 may move the frame 80 by the distance X toward one of the left and the right, depending on the direction of rotation of the helical cam 48.

The image sensor holding mechanism 150 is fastened to the frame 80. Therefore, the position of the image sensor 151 in relation to the body 20 may be changed by moving the needle bar case 21. In a case where the image sensor 151 captures an image of the sewing object 39 that is held by the embroidery frame 84, the needle bar case 21 may be moved such that the number 8 engaging roller 42 is engaged with the positioning portion 481.

Figure 4:
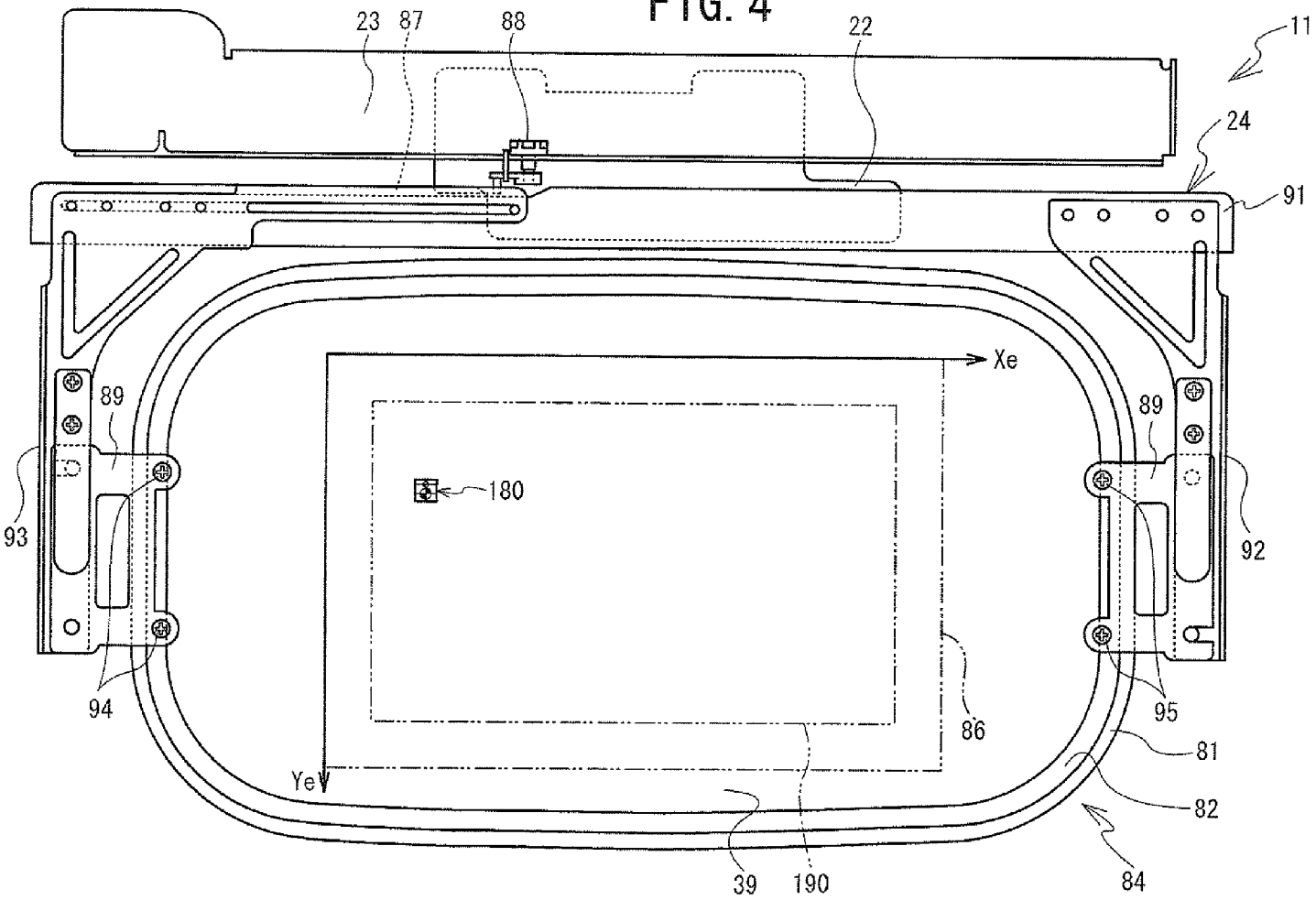
FIG. 4 is a plan view of an embroidery frame moving mechanism 11.

The embroidery frame 84 and the embroidery frame moving mechanism 11 will be explained with reference to FIG. 4. The embroidery frame 84 includes an outer frame 81, and inner frame 82, and a left-right pair of coupling portions 89. The embroidery frame 84 may hold the sewing object 39 clamped between the outer frame 81 and the inner frame 82. Each of the coupling portions 89 is a plate-shaped member that is rectangular in a plan view and that has a rectangular cut-out in a central portion of the plate-shaped member. One of the coupling portions 89 is fastened by a screw 95 to the right-hand portion of the inner frame 82. The other of the coupling portions 89 is fastened by a screw 94 to the left-hand portion of the inner frame 82. A plurality of types of embroidery frames other than the embroidery frame 84, with different sizes and shapes, can be mounted in the sewing machine 1. Of the embroidery frames that can be used in the sewing machine 1, the embroidery frame 84 is the embroidery frame with the greatest width in the left-right direction (the greatest distance between the coupling portions 89 in the left-right direction). A sewing area 86 is defined in an area on the inner side of the inner frame 82, in accordance with the type of the embroidery frame 84.

The embroidery frame moving mechanism 11 includes a holder 24, an X carriage 22, an X axis drive mechanism (not shown in the drawings), the Y carriage 23, a Y axis drive mechanism (not shown in the drawings), and a detecting device 88. The holder 24 may support the embroidery frame 84 such that the embroidery frame 84 can be attached to and detached from the holder 24. The holder 24 includes an attaching portion 91, a right arm portion 92, a left arm portion 93, and a detected portion 87. The attaching portion 91 is a plate member that is rectangular in a plan view, with its long sides running in the left-right direction. The right arm portion 92 is a plate member that extends in the front-rear direction and is secured to the right end of the attaching portion 91. The left arm portion 93 is a plate member that extends in the front-rear direction, and is attached to the left portion of the attaching portion 91. The left arm portion 93 is secured such that the position of the left arm portion 93 can be adjusted in the left-right direction in relation to the attaching portion 91. The right arm portion 92 may be engaged with one of the coupling portions 89. The left arm portion 93 may be engaged with the other of the coupling portions 89.

The distance between the left and right coupling portions 89 may vary according to the type of the embroidery frame that is affixed to the holder 24. After adjusting the position of the left arm portion 93 in the left-right direction according to the embroidery frame that will be used, the user may fix the position of the left arm portion 93. The detected portion 87 is provided on the left arm portion 93. The detected portion 87 is a narrow, plate-shaped member that extends in the left-right direction. When the position of the left arm portion 93 in the left-right direction is adjusted, the detected portion 87 is moved in the left-right direction together with the left arm portion 93. A plurality of stepped portions (not shown in the drawings) are formed in the detected portion 87. One of the stepped portions may come into contact with a detector element (not shown in the drawings) of the detecting device 88, which will be described below. The heights of the stepped portions differ, such that the stepped portions form a stairway shape.

The detecting device 88 is affixed to the Y carriage 23. The detecting device 88 is a rotary potentiometer. Although it is not shown in detail in the drawings, the detector element is provided on a rotating shaft of the potentiometer. A tip portion of the detector element may come into contact with one of the stepped portions of the detected portion 87, and the detecting device 88 may output an electrical signal that varies according to the angle of rotation of the detector element. The heights of the stepped portions of the detected portion 87 differ for each position of the left arm portion 93 in the left-right direction in relation to the attaching portion 91, that is, for each type of the embroidery frame 84. Therefore, the type of the embroidery frame 84 that is attached to the embroidery frame moving mechanism 11 can be specified based on the electrical signal that is output by the detecting device 88. For example, Japanese Laid-Open Patent Publication No. 2004-254987 discloses a detecting device and a detected portion, the relevant portions of which are incorporated by reference.

The X carriage 22 is a plate-shaped member that extends in the left-right direction, and a portion of the X carriage 22 projects farther toward the front than does the front face of the Y carriage 23. The attaching portion 91 of the holder 24 may be attached to the X carriage 22. The X axis drive mechanism (not shown in the drawings) includes the X axis motor 132 (refer to FIG. 5) and a linear movement mechanism (not shown in the drawings). The X axis motor 132 is a stepping motor. The linear movement mechanism includes a timing pulley (not shown in the drawings) and a timing belt (not shown in the drawings). Using the X axis motor 132 as a drive source, the linear movement mechanism may move the X carriage 22 in the left-right direction (the X axis direction).

The Y carriage 23 has a box shape that extends in the left-right direction. The Y carriage 23 supports the X carriage 22 such that the X carriage 22 can be moved in the left-right direction. The Y axis drive mechanism (not shown in the drawings) includes a left-right pair of moving bodies 26 (refer to FIG. 1), the Y axis motor 134 (refer to FIG. 5), and a linear movement mechanism (not shown in the drawings). The moving bodies 26 are respectively coupled to the undersides of the left and right ends of Y carriage 23. The moving bodies 26 pass vertically through the guide slots 25. The Y axis motor 134 is a stepping motor. The linear movement mechanism includes a timing pulley (not shown in the drawings) and a timing belt (not shown in the drawings). Using the Y axis motor 134 as a drive source, the linear movement mechanism may move the moving bodies 26 through the guide slots 25 in the front-rear direction (the Y axis direction).

The embroidery frame 84 may be moved in two directions (the left-right direction and the front-rear direction) by the embroidery frame moving mechanism 11, in accordance with data that are expressed in a coordinate system of the embroidery frame moving mechanism 11 (hereinafter referred to as the "embroidery coordinate system"). The embroidery coordinate system in the present embodiment is associated with a world coordinate system. The world coordinate system is a coordinate system that describes the whole of space. The world coordinate system is a coordinate system that is not affected by factors such as the center of gravity or the like of an object of which an image is captured. As shown in FIG. 4, for example, the embroidery coordinate system (Xe, Ye) is defined such that the origin point of the embroidery coordinate system is positioned to the left rear from the sewing area 86. In the embroidery coordinate system, one millimeter is expressed as one unit by the coordinates. The direction from the left to the right is the positive Xe direction. The direction from the rear to the front is the positive Ye direction.

The operation that forms a stitch on the sewing object 39 held by the embroidery frame 84 will be explained with reference to FIGS. 1 to 5. The embroidery frame 84 that holds the sewing object 39 is supported by the holder 24 of the embroidery frame moving mechanism 11 (refer to FIGS. 1 and 4). First, one of the six needle bars 31 is selected by the moving of the needle bar case 21 in the left-right direction. The embroidery frame 84 is moved to a specified position by the embroidery frame moving mechanism 11. The needle bar drive mechanism 85 is driven when a drive shaft 74 is rotated by the sewing machine motor 122. The rotational movement of the drive shaft 74 is transmitted to the coupling member 76 through the thread take-up lever drive cam 75. The coupling member 76 is pivotally supported on the transmitting member 77. The guide bar 78 is positioned parallel to the needle bar 31. The transmitting member 77 is guided by the guide bar 78 and is driven up and down. The up-and-down movement is transmitted to the needle bar 31 through the coupling pin (not shown in the drawings), and the needle bar 31, to which the needle 35 is attached, is driven up and down. Through a link mechanism, which is not shown in detail in the drawings, the thread take-up lever 19 is driven up and down by the rotation of the thread take-up lever drive cam 75. Furthermore, the rotation of the drive shaft 74 is transmitted to the shuttle drive mechanism (not shown in the drawings), and the shuttle (not shown in the drawings) is rotationally driven. Thus, the needle 35, the thread take-up lever 19, and the shuttle are driven in synchronization, and a stitch is formed on the sewing object 39.

Figure 5:
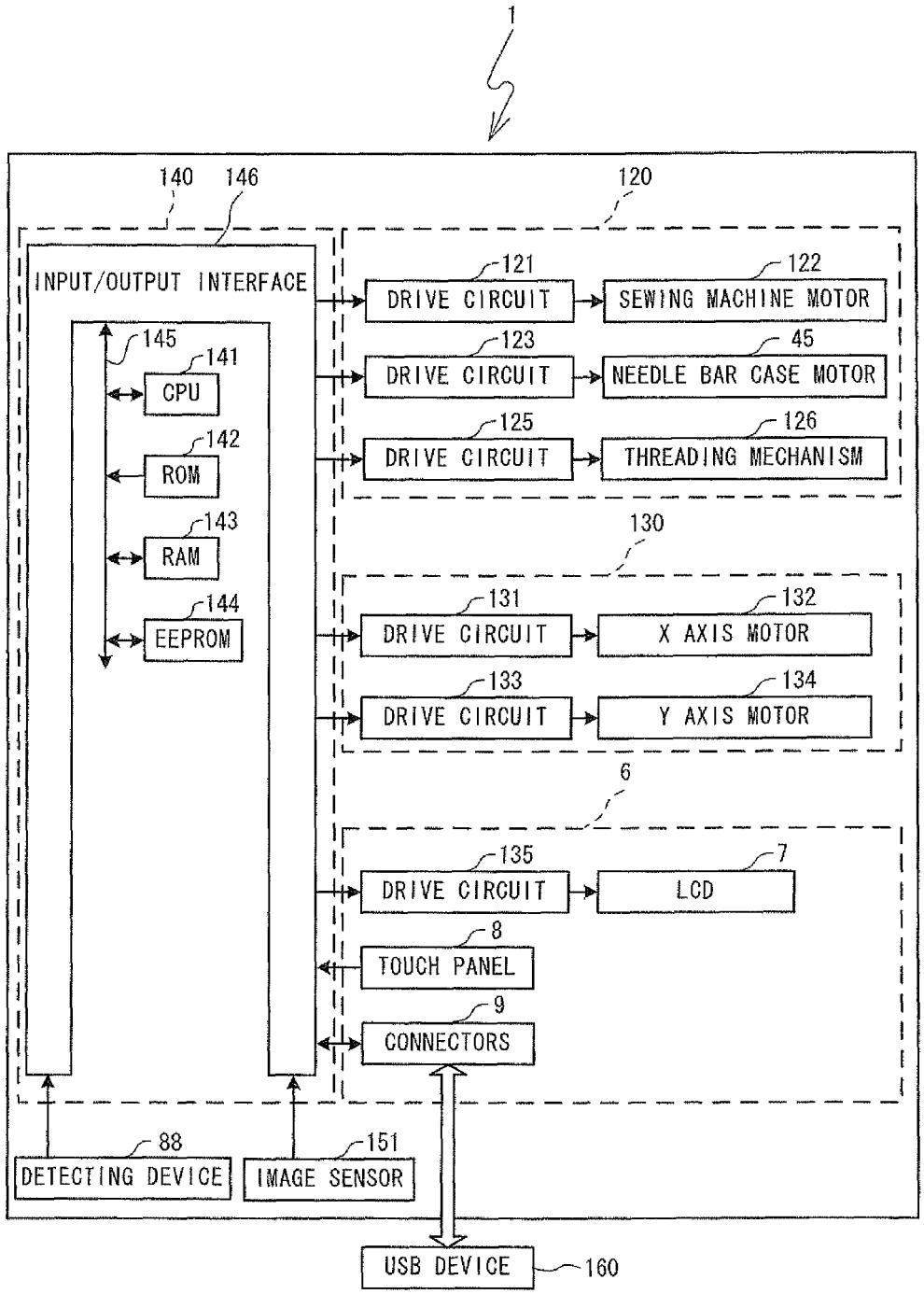
FIG. 5 is a block diagram that shows an electrical configuration of the multi-needle sewing machine 1.

The electrical configuration of the sewing machine 1 will be explained with reference to FIG. 5. As shown in FIG. 5, the sewing machine 1 includes a needle drive portion 120, a sewing object drive portion 130, the operation portion 6, the detecting device 88, the image sensor 151, and the control portion 140.

The needle drive portion 120 includes drive circuits 121, 123, 125, the sewing machine motor 122, the needle bar case motor 45, and a threading mechanism 126. The sewing machine motor 122 may move the needle bars 31 reciprocally up and down. The drive circuit 121 drives the sewing machine motor 122 in accordance with a control signal from the control portion 140. The needle bar case motor 45 may move the needle bar case 21 to the left and to the right in relation to the body 20. The drive circuit 123 drives the needle bar case motor 45 in accordance with a control signal from the control portion 140. The threading mechanism 126 is provided below the front end of the arm 4, although not shown in detail in the drawings. The threading mechanism 126 is used for passing the upper thread 15 (refer to FIG. 1) through the eye (not shown in the drawings) of the needle 35 that is attached to the needle bar 31 that is positioned directly above the needle hole 36. A drive circuit 125 drives the threading mechanism 126 in accordance with a control signal from the control portion 140.

The sewing object drive portion 130 includes drive circuits 131, 133, the X axis motor 132, and the Y axis motor 134. The X axis motor 132 may move the embroidery frame 84 (refer to FIG. 1) to the left and to the right. The drive circuit 131 drives the X axis motor 132 in accordance with a control signal from the control portion 140. The Y axis motor 134 may move the embroidery frame 84 forward and backward. The drive circuit 133 drives the Y axis motor 134 in accordance with a control signal from the control portion 140.

The operation portion 6 includes the touch panel 8, the connectors 9, a drive circuit 135, and the LCD 7. The drive circuit 135 drives the LCD 7 in accordance with a control signal from the control portion 140. The connectors 9 are provided with functions that connect to the USB device 160. The USB device 160 may be a personal computer, a USB memory, or another sewing machine 1, for example.

The control portion 140 includes a CPU 141, a ROM 142, a RAM 143, an EEPROM 144, and an input/output interface 146, all of which are connected to one another by a bus 145. The needle drive portion 120, the sewing object drive portion 130, the operation portion 6, and the image sensor 151 are each connected to the input/output interface 146.

The CPU 141 conducts main control over the sewing machine 1. The CPU 141 executes various types of computations and processing that are related to sewing in accordance with various types of programs stored in a program storage area (not shown in the drawings) in the ROM 142. The programs may be stored in an external storage device such as a flexible disk.

The ROM 142 includes a plurality of storage areas such as the program storage area and a pattern storage area, which are not shown in the drawings. Various types of programs for operating the sewing machine 1, including a main program, are stored in the program storage area. The main program is a program for executing main processing that will be described below. Embroidery data for sewing embroidery patterns are stored in the pattern storage area in association with pattern IDs. The pattern IDs are used in processing that specifies an embroidery pattern.

The RAM 143 is a storage element that can be read from and written to as desired. The RAM 143 includes storage areas that store computation results and the like from computational processing by the CPU 141 as necessary. The EEPROM 144 is a storage element that can be read from and written to. Various types of parameters for the sewing machine 1 to execute various types of processing are stored in the EEPROM 144.

Figure 6:
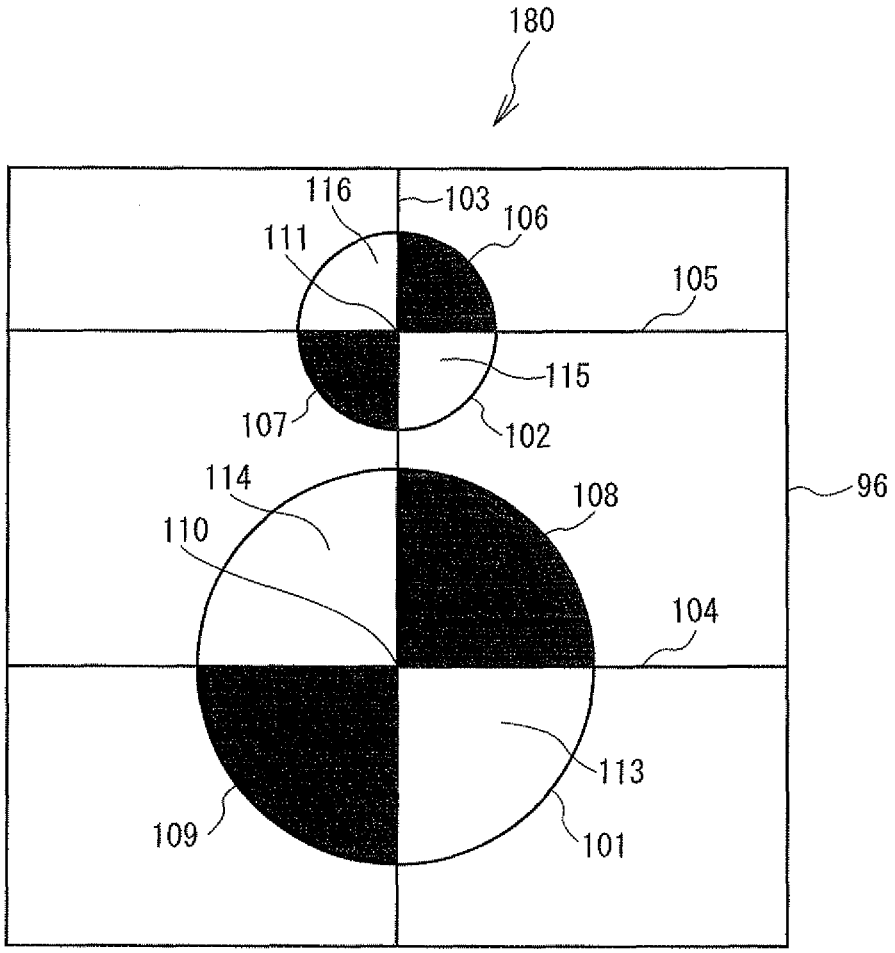
FIG. 6 is an explanatory figure of a marker 180.

The marker 180 will be explained with reference to FIG. 6. The left-right direction and the up-down direction of the page of FIG. 6 are respectively defined as the left-right direction and the up-down direction of the marker 180. The marker 180 may be affixed to the top surface of the sewing object 39. The marker 180 may be used, for example, for specifying a sewing position for the embroidery pattern on the sewing object 39. As shown in FIG. 6, the marker 180 is an object on which a pattern is drawn on a thin, plate-shaped base material sheet 96 that is transparent. The base material sheet 96 has a square shape, 10 millimeters on a side. Specifically, a first circle 101 and a second circle 102 are drawn on the base material sheet 96. The second circle 102 is disposed above the first circle 101 and has a smaller diameter than does the first circle 101. Line segments 103 to 105 are also drawn on the base material sheet 96. The line segment 103 extends from the top edge to the bottom edge of the marker 180 and passes through a center 110 of the first circle 101 and a center 111 of the second circle 102. The line segment 104 is orthogonal to the line segment 103, passes through the center 110 of the first circle 101, and extends from the right edge to the left edge of the marker 180. The line segment 105 is orthogonal to the line segment 103, passes through the center 111 of the second circle 102, and extends from the right edge to the left edge of the marker 180.

Of the four areas that are defined by the perimeter of the first circle 101 and the line segments 103 and 104, an upper right area 108 and a lower left area 109 are filled in with black, and a lower right area 113 and an upper left area 114 are filled in with white. Similarly, of the four areas that are defined by the second circle 102 and the line segments 103 and 105, an upper right area 106 and a lower left area 107 are filled in with black, and a lower right area 115 and an upper left area 116 are filled in with white. The other portions of the surface on which the pattern of the marker 180 is drawn are transparent. The bottom surface of the marker 180 is coated with a transparent adhesive. When the marker 180 is not in use, a release paper is affixed onto the bottom surface of the marker 180. The user may peel the marker 180 off of the release paper and affix the marker 180 onto the surface of the sewing object 39.

Figure 7:
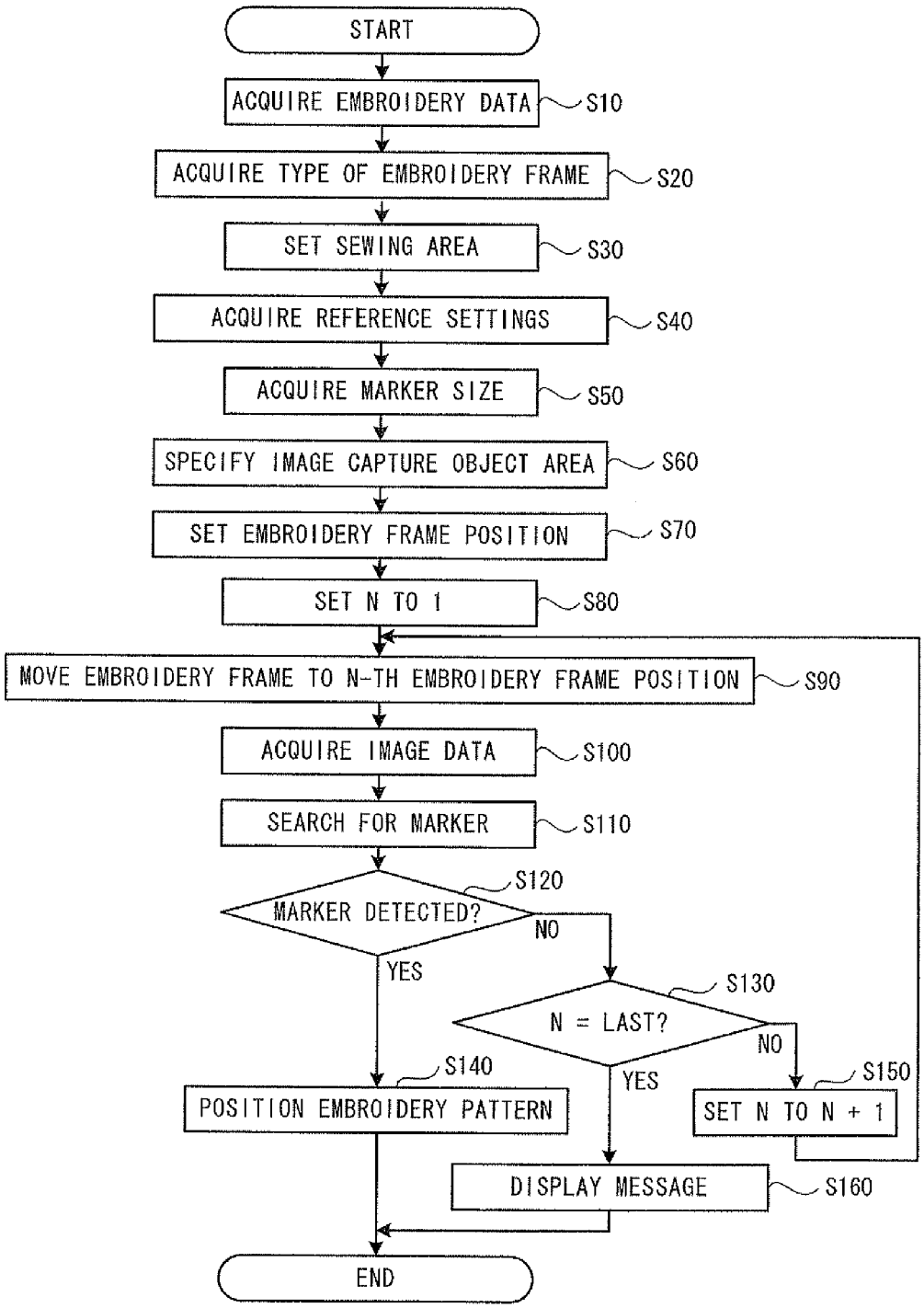
FIG. 7 is a flowchart of main processing.

The main processing will be explained with reference to FIG. 7. In the main processing, the positioning of the selected embroidery pattern is set based on the marker 180 that is disposed on the surface of the sewing object 39. The main processing that is shown in FIG. 7 is performed in a case where a start command has been input by a panel operation after the embroidery pattern has been selected by a panel operation. The CPU 141 may execute the main program for performing the main processing, which is stored in the ROM 142 shown in FIG. 5. In the explanation that follows, the length in the Ye axis direction is referred to as the width, and the length in the Xe axis direction is referred to as the height. As a specific example, a case will be explained in which the positioning of an embroidery pattern with a width PW of 100 millimeters and a height PH of 50 millimeters is set based on the marker 180 that is disposed on the surface of the sewing object 39 that is held in the embroidery frame 84. When the main processing starts, the needle bar case 21 may be positioned in the position where the number 8 engaging roller 42 engages with the positioning portion 481 of the helical cam 48.

As shown in FIG. 7, in the main processing, the embroidery data for sewing the selected embroidery pattern are acquired from the ROM 142, and the acquired embroidery data are stored in the RAM 143 (Step S10). The embroidery data prescribe the initial positioning and the initial size of the selected embroidery pattern. In the specific example, the embroidery data for sewing the embroidery pattern with the width PW of 100 millimeters and the height PH of 50 millimeters are acquired. Next, the type of the embroidery frame 84 that is attached to the embroidery frame moving mechanism 11 is acquired, based on the electrical signal from the detecting device 88, and the acquired type of the embroidery frame 84 is stored in the RAM 143 (Step S20). Next, the sewing area is set that corresponds to the acquired type of the embroidery frame 84, and the sewing area that has been set is stored in the RAM 143 (Step S30). A correspondence relationship between the type of the embroidery frame and the sewing area is stored in the EEPROM 144 in advance. In the specific example, based on the correspondence relationship that is stored in the EEPROM 144, values of (0, 0), (0, 200), (300, 0), and (300, 200) are set for the coordinates (Xe, Ye) that describe the sewing area 86 (having a width FW of 200 millimeters and a height FH of 300 millimeters) that corresponds to the type of the embroidery frame 84.

Next, reference settings are acquired, and the acquired reference settings are stored in the RAM 143 (Step S40). The reference settings include at least one of the position and the angle of the embroidery pattern in relation to the marker 180 that is disposed on the sewing object 39 that is held by the embroidery frame 84. In the present embodiment, the reference settings are both the position and the angle of the embroidery pattern in relation to the marker 180. Specifically, in the reference settings, the coordinates of the center 110 of the first circle 101 of the marker 180 in the embroidery coordinate system (hereinafter referred to as the "position of the marker 180") are defined as the center of the embroidery pattern. In the reference settings, the angle between the positive Xe direction and the vector from the center 110 of the first circle 101 of the marker 180 to the center 111 of the second circle 102 (hereinafter referred to as the "angle of the marker 180") is defined as the angle of the embroidery pattern. The reference settings may be set in advance and stored in the EEPROM 144. The user may designate the reference settings every time the main processing is performed. Next, the size of the marker 180 is acquired, and the acquired size is stored in the RAM 143 (Step S50). In the specific example, the size of the marker 180 (the length MS of one side being 10 millimeters) that has been stored in the EEPROM 144 in advance is acquired.

Next, an image capture object area of the image sensor 151 is specified, and the specified image capture object area is stored in the RAM 143 (Step S60). The image capture object area is specified based on at least the sewing area that was acquired by the processing at Step S30, the embroidery data that were acquired by the processing at Step S10, and the reference settings that were acquired by the processing at Step S40. The image capture object area is the area within which it is assumed that the marker 180 is located. In the present embodiment, the CPU 141 specifies the area within which the marker 180 can be positioned as the image capture object area in a case where the embroidery pattern is disposed within the sewing area 86 based not only on the sewing area, the embroidery data, and the reference settings that have been acquired, but also on the size of the marker 180 that was acquired by the processing at Step S50.

Specifically, the image capture object area is specified by the procedure that is hereinafter described. First, a reference size is computed based on the embroidery data that were acquired by the processing at Step S10. The reference size is used in calculating the image capture object area. The reference size is computed by taking into account a case in which the embroidery pattern is positioned by rotating the embroidery pattern in relation to its initial position. Specifically, the CPU 141 may set each of a width PCW and a height PCH of the reference size to the smaller value for the width and the height of the embroidery pattern. In the specific example, the width PCW and the height PCH of the reference size are each 50 millimeters. Next, in the reference settings in the present embodiment, the coordinates of the center 110 of the first circle 101 of the marker 180 are used to define the center of the embroidery pattern, as described above, so a width SW and a height SH of a rectangular image capture object area may be computed as hereinafter described. The width SW of the image capture object area is obtained as SW=FW−PCW+MS/2. The height SH of the image capture object area is obtained as SH=FH−PCH+MS/2. Therefore, in the specific example, an image capture object area 190 is specified by the values (22.5, 22.5), (22.5, 177.5), (277.5, 22.5), and (277.5, 177.5) for the coordinates (Xe, Ye) that describe an area in which the width SW is 155 millimeters and the height SH is 255 millimeters, with the center of the sewing area 86 (150, 100) defined as the center of the image capture object area 190.

Next, at least one embroidery frame position is set for capturing an image of the image capture object area 190 that was specified by the processing at Step S60, and the at least one embroidery frame position that has been set is stored in the RAM 143 (Step S70). The at least one embroidery frame position is the position to which the embroidery frame 84 is moved and that is set such that the image capture object area 190 that has been specified will be included in the image capture area of the image sensor 151. The processing at Step S70 may be performed using a known method. In a case where an area over which the image sensor 151 can capture an image in a single operation has a width of 60 millimeters and a height of 80 millimeters, twelve embroidery frame positions are defined in the specific example. Each of the embroidery frame positions is associated with a move sequence and is stored in the RAM 143. Next, a variable N is set to 1, and the variable N that has been set is stored in the RAM 143 (Step S80). The variable N is a variable for reading the embroidery frame positions in order by the move sequence. Next, control signals are output to the drive circuits 131 and 133, and the embroidery frame 84 is moved to the N-th embroidery frame position (Step S90). Next, image data that have been generated by the image sensor 151 are acquired, and the acquired image data are stored in the RAM 143 (Step S100). Next, processing is performed that searches for the marker 180 based on the acquired image data (Step S110). For example, Japanese Laid-Open Patent Publication No. 2009-172123 discloses the processing that searches for a marker, the relevant portions of which are incorporated by reference. In a case where the marker 180 is detected in the processing at Step S110, the position and the angle of the marker 180 are computed based on the image data.

If the marker 180 has been detected (YES at Step S120), the positioning of the selected embroidery pattern is performed based on the position and the angle of the marker 180 (Step S140). In the specific example, the embroidery data that were acquired by the processing at Step S10 are corrected such that the position of the marker 180 serves as the center of the embroidery pattern and the angle of the marker 180 serves as the angle of the embroidery pattern. For example, Japanese Laid-Open Patent Publication No. 2009-172123 discloses the processing that positions the embroidery pattern, the relevant portions of which are incorporated by reference.

If the marker 180 has not been detected (NO at Step S120), a determination is made as to whether N is the last move sequence (Step S130). If N is not the last move sequence (NO at Step S130), the value of N is incremented, and the incremented N is stored in the RAM 143 (Step S150). Next, the processing returns to Step S90. If N is the last move sequence (YES at Step S130), a control signal is output to the drive circuit 135, and a message is displayed on the LCD 7 (Step S160). The message may be, for example, "The marker was not found. Please check the marker position." Following the processing at Steps S140 and S160, the main processing is terminated.

In the specific example that is described above, the maximum number of image captures in a case where the entire sewing area 86 is defined as the image capture object area is sixteen. On the other hand, the sewing machine 1 according to the present embodiment may take the size of the marker 180 into consideration and may set, as the image capture object area, an area within which it is assumed that the marker 180 is located and that is smaller than the sewing range 86. In that case, in the specific example that is described above, the maximum number of image captures is twelve. In other words, the sewing machine 1 may exclude from the image capture object area the area in which it is assumed that the marker 180 is not located. The sewing machine 1 may therefore set the image capture object area for detecting the marker 180 more appropriately than would be the case if the entire sewing area 86 were the image capture object area. The sewing machine 1 may detect the marker 180 more efficiently than would be the case if the range in which it is assumed that the marker 180 is not located were included in the image capture object area.

The sewing machine of the present disclosure is not limited to the above embodiments that are described above, and various types of modifications may be made within the scope of the present disclosure. For example, modifications (A) to (C) below may be made as desired.

(A) The configuration of the sewing machine 1 can be modified as desired. The sewing machine 1 may be a domestic sewing machine or an industrial sewing machine. The type and the positioning of the image sensor 151 may be modified as desired. For example, the image sensor 151 may be an image capture element other than a CMOS image sensor, such as a CCD camera. The direction in which the embroidery frame moving mechanism 11 moves the embroidery frame 84 can be modified as desired.

(B) The configuration of the marker may be modified as desired. For example, the pattern, the color, the shape, the size, the material, the positioning, and the number of markers may be included in the configuration of the marker. The reference settings may be for at least one of the position and the angle of the embroidery pattern in relation to the marker that is disposed on the sewing object. For example, in the reference settings, the center 110 of the first circle 101 of the marker 180 may be defined as a reference point for the embroidery pattern. In a case where the embroidery pattern is rectangular, for example, the reference point for the embroidery pattern may be one of the center of the embroidery pattern, one of the four vertices of the rectangle, and a point that the user designates. The size of the embroidery pattern may be specified based on the embroidery data and may not be specified as the rectangle.

(C) The main processing may be modified as necessary. The modifications described below may be made to the main processing.

(C-1) In the processing at Step S20, the type of the embroidery frame that is designated by a panel operation or the like may be acquired. In the processing at Step S30, the sewing area that is designated by a panel operation or the like may be acquired. In the processing at Step S50, the marker 180 size that is designated by a panel operation or the like may be acquired.

(C-2) The image capture object area may be specified based on conditions that include the sewing area, the embroidery data, and the reference settings. The method for specifying the image capture object area may be modified as desired. For example, in a case where it is permissible to ignore the size of the marker 180, the image capture object area may be specified without being based on the size of the marker 180. In that case, the processing at Step S50 could be omitted. In a case where only the position of the embroidery pattern is set based on the positioning of the marker 180, the width SW and the height SH of the image capture object area may be specified using the size of the embroidery pattern, for example, instead of the reference size, as hereinafter described. In a case where the reference settings are the same as those in the embodiment that is described above, the width SW of the image capture object area may be obtained as SW=FW−PW+MS/2. The height SH of the image capture object area may be obtained as SH=FH−PH+MS/2.

(C-3) At least a portion of the image capture object area may be positioned within the image capture area of the image sensor 151 by moving the needle bar case 21. At least a portion of the image capture object area may be positioned within the image capture area of the image sensor 151 by combining movement of the embroidery frame 84 and movement of the needle bar case 21.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

an image capture portion that is configured to capture an image of a sewing object that is held by an embroidery frame;

a data acquisition portion that is configured to acquire embroidery data for sewing an embroidery pattern, the embroidery data defining a size of the embroidery pattern;

an area setting portion that is configured to set a size and a position of a sewing area that is an area within which the embroidery pattern can be sewn on the sewing object;

a setting acquisition portion that is configured to acquire, as a reference setting, a setting of at least one of a position and an angle of the embroidery pattern in relation to a marker that is disposed on the sewing object;

size calculation portion that is configured to calculate a size of an image capture object area for the image capture portion, based on the size of the sewing area, the size of the embroidery pattern, and the reference setting, the image capture object area being an area that is smaller than the sewing area; and a position setting portion that is configured to set a position of the image capture object area such that a center of the image capture object area coincides with a center of the sewing area.

2. The sewing machine according to claim 1, wherein the size calculation portion is configured to calculate, as the size of the image capture object area, a size of an area within which the marker can be positioned in a case where the embroidery is positioned within the sewing area, based on the size of the sewing area, the size of the embroidery pattern, and the reference setting.

3. The sewing machine according to claim 1, wherein the size calculation portion is configured to calculate the size of the image capture object area based on the size of the sewing area, the size of the embroidery pattern, the reference setting, and a size of the marker.

4. The sewing machine according to claim 1, further comprising:

a moving mechanism to which the embroidery frame can be detachably attached and that is configured to move the embroidery frame in relation to a body of the sewing machine; and a movement control portion that is configured to control operation of the moving mechanism, wherein the movement control portion is configured to control the moving mechanism to move the embroidery frame to a position where the image capture portion can capture an image of at least a portion of the image capture object area, the sewing machine further comprises a detection portion that is configured to detect at least one of a position and an angle of the marker that is positioned within the image capture object area, based on image data that the image capture portion has generated by capturing an image of at least a portion of the image capture object area.

5. A non-transitory computer-readable medium storing a control program executable on a sewing machine, the program comprising computer-executable instructions that cause a computer of the sewing machine to perform the steps of:

causing an image capture portion of the sewing machine to generate image data that indicates a captured image of a sewing object that is held by an embroidery frame;

acquiring embroidery data for sewing an embroidery pattern, the embroidery data defining a size of the embroidery pattern;

setting a size and a position of a sewing area that is an area within which the embroidery pattern can be sewn on the sewing object;

acquiring, as a reference setting, a setting of at least one of a position and an angle of the embroidery pattern in relation to a marker that is disposed on the sewing object;

calculating a size of an image capture object area for the image capture portion, based on the size of the sewing area, the size of the embroidery pattern, and the reference setting, the image capture object area being an area that is smaller than the sewing area, and setting a position of the image capture object area such that a center of the image capture object area coincides with a center of the sewing area.

6. The non-transitory computer-readable medium according to claim 5, wherein the calculating the size of the image capture object area includes calculating, as the size of the image capture object area, a size of an area within which the marker can be positioned in a case where the embroidery pattern is positioned within the sewing area, based on the size of the sewing area, the size of the embroidery pattern, and the reference setting.

7. The non-transitory computer-readable medium according to claim 5, wherein the calculating the size of the image capture object area includes calculating the size of the image capture object area based on the size of the sewing area, the size of the embroidery pattern, the reference setting, and a size of the marker.

8. The non-transitory computer-readable medium according to claim 5, wherein the program further comprises computer-executable instructions that cause the computer to perform the steps of:

controlling operation of a moving mechanism that is included in the sewing machine, to which the embroidery frame can be detachably attached, and that is configured to move the embroidery frame in relation to a body of the sewing machine, the controlling the operation of the moving mechanism including controlling the moving mechanism to move the embroidery frame to a position where the image capture portion can capture an image of at least a portion of the image capture object area, and detecting at least one of a position and an angle of the marker that is positioned within the image capture object area, based on image data that has been generated by capturing an image of at least a portion of the image capture object area.

* * * * *